US011628665B2

(12) United States Patent
Moore

(10) Patent No.: US 11,628,665 B2
(45) Date of Patent: Apr. 18, 2023

(54) DIGITAL INK APPLICATION MODULE AND METHODS THEREOF

(71) Applicant: XEROX CORPORATION, Norwalk, CT (US)

(72) Inventor: Steven R. Moore, Pittsford, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 17/462,433

(22) Filed: Aug. 31, 2021

(65) Prior Publication Data

US 2023/0064009 A1 Mar. 2, 2023

(51) Int. Cl.
*B41F 31/13* (2006.01)

(52) U.S. Cl.
CPC ..... *B41F 31/13* (2013.01)

(58) Field of Classification Search
CPC .. B41F 31/13; B41F 23/02; B41F 7/00; B41F 7/26; B41F 7/30; B41M 1/06; B41J 2/0057; B41J 2002/012
See application file for complete search history.

(56) References Cited

U.S. PATENT DOCUMENTS 4,368,669 A * 1/1983 Love, III ..... B41M 5/20 427/469
8,011,300 B2 9/2011 Cyman, Jr. et al.
8,061,270 B2 11/2011 Cyman, Jr. et al.
8,402,891 B2 3/2013 Cyman, Jr. et al.
8,733,248 B2 5/2014 DeJoseph et al.
8,833,257 B2 9/2014 Cyman, Jr. et al.
8,869,698 B2 10/2014 DeJoseph et al.
8,881,651 B2 11/2014 DeJoseph et al.
8,887,633 B2 11/2014 Cyman, Jr. et al.
8,887,634 B2 11/2014 Cyman, Jr. et al.
8,894,198 B2 11/2014 Hook et al.
8,899,151 B2 12/2014 Cyman, Jr. et al.
8,967,044 B2 3/2015 DeJoseph et al.
9,114,654 B2 8/2015 Cyman, Jr. et al.
9,463,643 B2 10/2016 DeJoseph et al.
9,505,253 B2 11/2016 DeJoseph et al.
2009/0056577 A1* 3/2009 Hook ..... B41J 11/0015 101/450.1
2012/0103212 A1 5/2012 Stowe et al.

* cited by examiner

*Primary Examiner* — Matthew G Marini
*Assistant Examiner* — Leo T Hinze
(74) *Attorney, Agent, or Firm* — MH2 Technology Law Group LLP

(57) ABSTRACT

A method for direct transfer printing is disclosed. The method for direct transfer printing includes applying a fountain solution to an imaging blanket in a negative image-wise manner using an inkjet printhead, contacting the imaging blanket with a printing substrate, transferring the fountain solution from the imaging blanket to the printing substrate, contacting the printing substrate with an inking station, and depositing an ink film from the inking station to the printing substrate in one or more locations on the printing substrate where there is no fountain solution. A module for a direct transfer marking process and a direct transfer printing system are also disclosed.

20 Claims, 5 Drawing Sheets

DIGITAL INK APPLICATION MODULE AND METHODS THEREOF

FIELD OF THE DISCLOSURE

This disclosure relates generally to marking and printing systems, and more specifically to a module and method for the digital application of inks for printing systems.

BACKGROUND

Lithographic printing techniques, referred to as variable data lithography, have been developed that use an imaging member comprising a non-patterned reimageable surface or imaging blanket that is initially uniformly coated with a dampening fluid layer. Regions of the dampening fluid are removed by exposure to a focused radiation source (e.g., a laser light source) to form pockets. A temporary pattern in the dampening fluid is thereby formed over the non-patterned imaging blanket in an image-wise manner. Ink applied thereover is retained in the pockets formed by the removal of the dampening fluid. The inked surface is then brought into contact with a print substrate, and the ink transfers from the pockets in the dampening fluid layer to the print substrate. The blanket then passes through a transfer nip where the ink is transferred under pressure to a media substrate. The blanket then passes through a cleaning station where any residual untransferred ink and/or dampening fluid is removed. A new uniform layer of dampening fluid may then be applied to the imaging blanket, and the process repeated.

A significant challenge has been the development of a blanket material which will allow for high transfer efficiency of the ink to the media. An additional challenge has been development of a cleaning system capable of removing residual ink from the blanket. A further challenge is the design of a reliable and cost-effective laser imager system. These challenges are impediments to variable lithographic printing methods working at optimum productively and cost-effectiveness for a wide range of media and inks.

There is thus a need in the art for a variable data lithographic process having reduced complexity, simplified printing, and reduced functional requirements on the imaging blanket and other system components.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

A method for direct transfer printing is disclosed. The method for direct transfer printing includes applying a fountain solution to an imaging blanket in a negative imagewise manner using an inkjet printhead, contacting the imaging blanket with a printing substrate, transferring the fountain solution from the imaging blanket to the printing substrate, contacting the printing substrate with an inking station, and depositing an ink film from the inking station to the printing substrate in one or more locations on the printing substrate where there is no fountain solution.

The method for direct transfer printing may include where the fountain solution is octamethylcycletetrasiloxane. The method for direct transfer printing may also include applying pressure to a backside of the imaging blanket when the imaging blanket is contacting the printing substrate. The method for direct transfer printing may include applying pressure to a backside of the printing substrate when the printing substrate is contacting the imaging blanket. The method for direct transfer printing may include applying pressure to a backside of the printing substrate when the printing substrate is contacting the inking station. The method for direct transfer printing may include fixing the ink film to the printing substrate. The fixing of the ink film may be completed using elevated temperature or ultraviolet radiation. The method for direct transfer printing may include removing residual fountain solution from the printing substrate. The method for direct transfer printing may include transporting the printing substrate with the ink film to a subsequent printing operation, a packaging operation, or a combination thereof.

A module for a direct transfer marking process is also disclosed. The module for a direct transfer marking process may include an imaging blanket, a printhead for ejecting fountain solution onto the imaging blanket disposed adjacent to the imaging blanket, an inking station positioned downstream from the imaging blanket. The module may include in contact with and configured to provide pressure against the printing substrate, the imaging blanket, the inking station, or a combination thereof. The module for a direct transfer marking process may include a fixing station. The fixing station further may include an ultraviolet radiation source. The printhead may eject fountain solution onto the imaging blanket in a negative imagewise manner. The gap between the printhead and the imaging blanket may be about 0.5 mm or less. The inking station delivers an ink having a viscosity of from about 0.05 pa-s to about 0.8 pa-s.

A direct transfer printing system is also disclosed, having a first marking module, which may include a first imaging blanket a first printhead for ejecting fountain solution onto the first imaging blanket, disposed adjacent to the first imaging blanket, a first inking station positioned downstream from the first imaging blanket configured to deposit an ink film to a printing substrate in one or more locations on the printing substrate, and one or more backer rolls in contact with and configured to provide pressure against the printing substrate, the first imaging blanket, the first inking station, or a combination thereof; and a second marking module, which may include a second imaging blanket, a second printhead for ejecting fountain solution onto the second imaging blanket, disposed adjacent to the second imaging blanket; a second inking station positioned downstream from the second imaging blanket configured to deposit an ink film to a printing substrate in one or more locations on the printing substrate, and one or more backer rolls in contact with and configured to provide pressure against the printing substrate, the second imaging blanket, the second inking station, or a combination thereof.

The direct transfer printing system may include a fixing station disposed between a location of the first marking module and a location of the second marking module. The direct transfer printing system may include a fixing station disposed in a process-wise location subsequent to a location of the second marking module. The first printhead may eject fountain solution onto the first imaging blanket in a negative imagewise manner and the second printhead may eject fountain solution onto the second imaging blanket in a negative imagewise manner.

BRIEF DESCRIPTION OF THE DRAWINGS

The accompanying drawings, which are incorporated in and constitute a part of this specification, illustrate embodiments of the present teachings and together with the description, serve to explain the principles of the present teachings.

Figure 1:
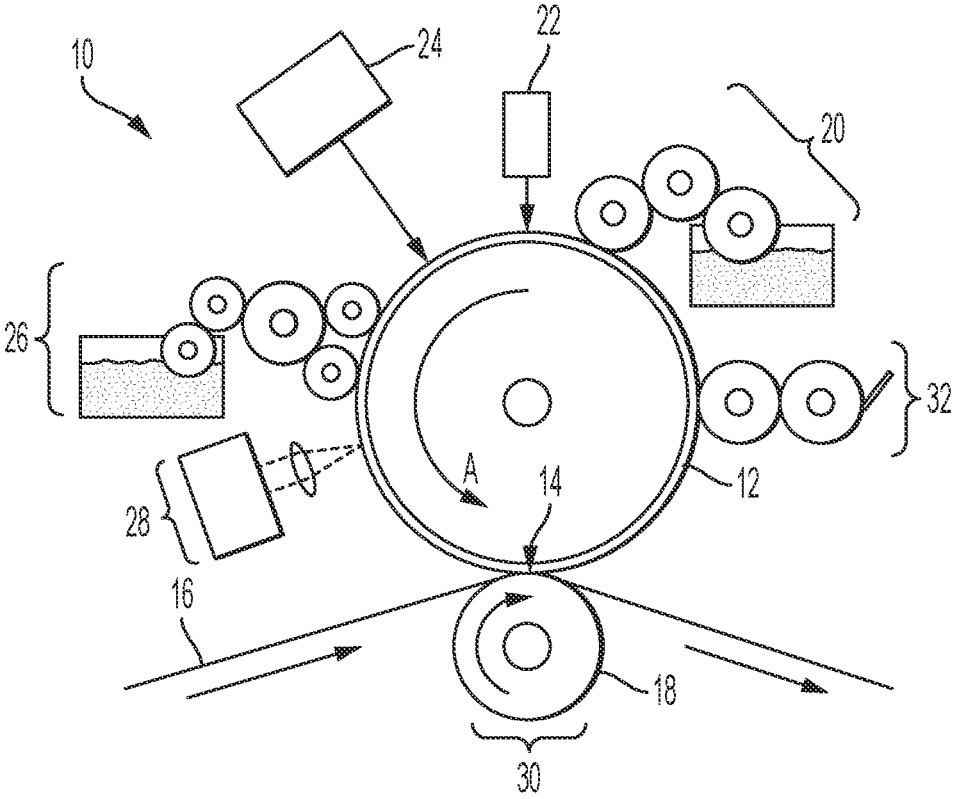
FIG. 1 RELATED ART
FIG. 1 is a side-view of a related art variable data lithography system.

It should be noted that some details of the figures may have been simplified and are shown to facilitate understanding of the embodiments rather than to maintain strict structural accuracy, detail, and scale.

DESCRIPTION OF THE EMBODIMENTS

Reference will now be made in detail to embodiments of the present disclosure. The following description is merely exemplary.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings, and it is to be understood that other embodiments may be utilized and that changes may be made without departing from the scope of the present teachings. The following description is, therefore, merely illustrative.

Although embodiments of the disclosure herein are not limited in this regard, the terms "plurality" and "a plurality" as used herein may include, for example, "multiple" or "two or more." The terms "plurality" or "a plurality" may be used throughout the specification to describe two or more components, devices, elements, units, parameters, or the like. For example, "a plurality of resistors" may include two or more resistors.

The terms "media substrate," "print substrate," and "print media" generally refer to a usually flexible physical sheet of paper, polymer, Mylar® material, plastic, or other suitable physical print media substrate, sheets, webs, etc., for images, whether precut or web fed.

The term "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and is any machine that reads marks on input sheets, or any combination of such machines.

As used herein, the term "ink-based digital printing" is used interchangeably with "variable data lithography printing" and "digital offset printing," and refers to lithographic printing of variable image data for producing images on a substrate that are changeable with each subsequent rendering of an image on the substrate in an image forming process. As used herein, "ink-based digital printing" includes offset printing of ink images using lithographic ink where the images are based on digital image data that may vary from image to image. As used herein, the ink-based digital printing may use a "digital architecture for lithographic ink" (DALI) or a variable data lithography printing system or a digital offset printing system, where the system is configured for lithographic printing using lithographic inks and based on digital image data, which may vary from one image to the next. As used herein, an ink-based digital printing system using DALI may be referred to as a DALI printer.

Further examples of variable data lithographic printing are disclosed in U.S. Patent Application Publication No. 2012/0103212 A1 (the '212 publication) published May 3, 2012, and based on U.S. patent application Ser. No. 13/095,714, which is commonly assigned, and the disclosure of which is hereby incorporated by reference herein in its entirety.

FIG. 1 depicts a related art variable data lithography printing system 10 as disclosed in the '212 Publication. A general description of the exemplary system 10 shown in FIG. 1 is provided here. Additional details regarding individual components and/or subsystems shown in the exemplary system 10 of FIG. 1 may be found in the '212 Publication. As shown in FIG. 1, the exemplary system 10 may include an imaging member 12 used to apply an inked image to a target image receiving media substrate 16 at a transfer nip 14. The transfer nip 14 is produced by an impression roller 18, as part of an image transfer mechanism 30, exerting pressure in the direction of the imaging member 12.

The exemplary system 10 may be used for producing images on a wide variety of image receiving media substrates 16. The '212 Publication explains the wide latitude of marking (printing) materials that may be used, including marking materials with pigment densities greater than 10% by weight. Increasing densities of the pigment materials suspended in solution to produce different color inks is generally understood to result in increased image quality and vibrancy. These increased densities, however, often result in precluding the use of such inks in certain image forming applications that are conventionally used to facilitate variable data digital image forming, including, for example, jetted ink image forming applications.

As noted above, the imaging member 12 may be comprised of a reimageable surface layer or plate formed over a structural mounting layer that may be, for example, a cylindrical core, or one or more structural layers over a cylindrical core. A fountain solution subsystem 20 may be provided generally comprising a series of rollers, which may be considered as dampening rollers or a dampening unit, for uniformly wetting the reimageable plate surface with a layer of dampening fluid or fountain solution, generally having a uniform thickness, to the reimageable plate surface of the imaging. The fountain solution may be applied by vapor deposition to create a thin layer of the fountain solution for uniform wetting and pinning. The method is disclosed in Xerox U.S. Pat. No. 9,327,487 by Liu and U.S. Pat. No. 9,267,646 by Knausdorf et al., the disclosure of both hereby incorporated by reference herein in its entirety.

Once the dampening fluid or fountain solution is metered onto the reimageable surface, a thickness of the layer of dampening fluid or fountain solution may be measured using a sensor 22 that provides feedback to control the metering of the dampening fluid or fountain solution onto the reimageable plate surface. An optical patterning subsystem 24 may be used to selectively form a latent image in the uniform fountain solution layer by imagewise patterning the fountain solution layer using, for example, laser energy. It is advantageous to form the reimageable plate surface of the imaging member 12 from materials that should ideally absorb most of the IR or laser energy emitted from the optical patterning subsystem 24 close to the reimageable plate surface. Forming the plate surface of such materials may advantageously aid in substantially minimizing energy wasted in heating the fountain solution and coincidentally minimizing lateral spreading of heat in order to maintain a high spatial resolution capability. The mechanics at work in the patterning process undertaken by the optical patterning subsystem 24 of the exemplary system 10 are described in detail with reference to FIG. 5 in the '212 Publication. Briefly, the application of optical patterning energy from the optical patterning subsystem 24 results in selective evaporation of portions of the uniform layer of fountain solution in a manner that produces a latent image.

The patterned layer of fountain solution having a latent image over the reimageable plate surface of the imaging member 12 is then presented or introduced to an inker subsystem 26. The inker subsystem 26 is usable to apply a uniform layer of ink over the patterned layer of fountain solution and the reimageable plate surface of the imaging member 12. In embodiments, the inker subsystem 26 may use an anilox roller to meter an ink onto one or more ink forming rollers that are in contact with the reimageable plate surface of the imaging member 12. In other embodiments, the inker subsystem 26 may include other traditional elements such as a series of metering rollers to provide a precise feed rate of ink to the reimageable plate surface. The inker subsystem 26 may deposit the ink to the areas representing the imaged portions of the reimageable plate surface, while ink deposited on the non-imaged portions of the fountain solution layer will not adhere to those portions.

Cohesiveness and viscosity of the ink residing on the reimageable plate surface may be modified by a number of mechanisms, including through the use of some manner of rheology control subsystem 28. In embodiments, the rheology control subsystem 28 may form a partial crosslinking core of the ink on the reimageable plate surface to, for example, increase ink cohesive strength relative to an adhesive strength of the ink to the reimageable plate surface. In embodiments, certain curing mechanisms may be employed. These curing mechanisms may include, for example, optical or photo curing, heat curing, drying, or various forms of chemical curing. Cooling may be used to modify rheology of the transferred ink as well via multiple physical, mechanical or chemical cooling mechanisms.

Substrate marking occurs as the ink is transferred from the reimageable plate surface to a substrate of image receiving media 16 using the transfer subsystem 30. With the adhesion and/or cohesion of the ink having been modified by the rheology control system 28, modified adhesion and/or cohesion of the ink causes the ink to transfer substantially completely preferentially adhering to the substrate 16 as it separates from the reimageable plate surface of the imaging member 12 at the transfer nip 14. Careful control of the temperature and pressure conditions at the transfer nip 14, combined with rheological adjustment of the ink, may allow transfer efficiencies for the ink from the reimageable plate surface of the imaging member 12 to the substrate 16 to exceed 95%. While it is possible that some fountain solution may also wet substrate 16, the volume of such transferred fountain solution will generally be minimal so as to rapidly evaporate or otherwise be absorbed by the substrate 16.

Finally, a cleaning system 32 is provided to remove residual products, including non-transferred residual ink and/or remaining fountain solution from the reimageable plate surface in a manner that is intended to prepare and condition the reimageable plate surface of the imaging member 12 to repeat the above cycle for image transfer in a variable digital data image forming operations in the exemplary system 10. An air knife may be employed to remove residual fountain solution. It is anticipated, however, that some amount of ink residue may remain. Removal of such remaining ink residue may be accomplished through use by some form of cleaning subsystem 32. The '212 Publication describes details of such a cleaning subsystem 32 including at least a first cleaning member such as a sticky or tacky member in physical contact with the reimageable surface of the imaging member 12, the sticky or tacky member removing residual ink and any remaining small amounts of surfactant compounds from the fountain solution of the reimageable surface of the imaging member 12. The sticky or tacky member may then be brought into contact with a smooth roller to which residual ink may be transferred from the sticky or tacky member, the ink being subsequently stripped from the smooth roller by, for example, a doctor blade.

The '212 Publication details other mechanisms by which cleaning of the reimageable surface of the imaging member 12 may be facilitated. Regardless of the cleaning mechanism, however, cleaning of the residual ink and fountain solution from the reimageable surface of the imaging member 12 is essential to prevent a residual image from being printed in the proposed system. Once cleaned, the reimageable surface of the imaging member 12 is again presented to the fountain solution subsystem 20 by which a fresh layer of fountain solution is supplied to the reimageable surface of the imaging member 12, and the process is repeated.

A persistent challenge in some variable data lithographic processes or digital printing technologies is the development of a cleaning system capable of removing residual ink from the imaging blanket. An additional challenge is the design of a reliable and cost-effective laser imager system. The solution to these and other system challenges and complexities may enable variable data lithographic processes or digital printing technologies to work more productively and cost-effectively while using a wide range of media and inks.

In certain embodiments as described herein, a variable data lithographic process may be adapted to print specifically onto smooth non-absorbent media substrates such as polymer films, glossy paper, or packaging material. Such films and other non-absorbent media are nearly universally used in the flexible packaging market. In embodiments described herein, a patterned image of fountain solution is ejected or deposited onto the imaging blanket using either one printhead or an array of drop-on-demand inkjet printheads. The patterned image is a negative of the desired image for a particular color separation and is therefore referred to as either a non-imagewise manner or negative imagewise manner. The imaging blanket next contacts the substrate and the negatively patterned fountain solution image is transferred onto the media or substrate via the processes of film splitting and forced wetting under pressure. The substrate then passes into an inking station where a high-viscosity or flexographic-like ink is deposited directly onto the substrate except where rejected by the fountain solution. Processes and apparatus as described herein may eliminate the need for an infrared or laser imager, a cleaning station, and may simplify the functional requirements of the imaging blanket, all of which may lead to a more productive, cost-effective, and less complex printing process. This approach may be advantageous as it enables a true digital method to apply flexographic type inks onto polymers and other media for use in packaging applications.

Figure 2:
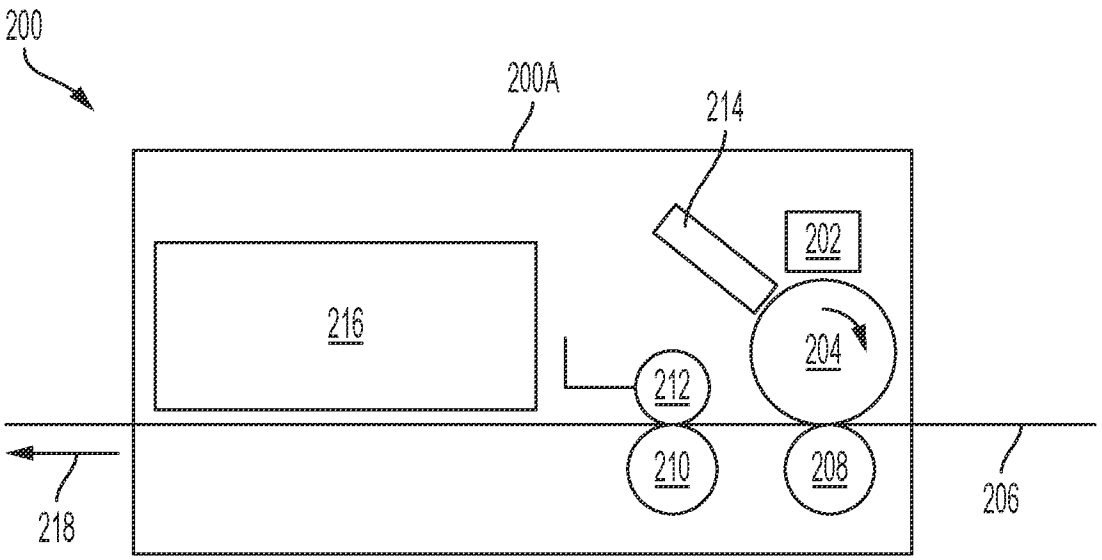
FIG. 2 is a schematic view of a module for a direct transfer marking process, according to an embodiment.

FIG. 2 is a schematic view of a module for a direct transfer marking process, according to an embodiment. A module for direct transfer marking process 200 is shown, which includes a modular enclosure 200A for a direct transfer marking process. This simplified schematic view illustrates a single-color marking station or module, using the print process as described herein. The modular enclosure 200A for the direct transfer marking process includes a printhead array 202 which refers to one or more drop-on-demand print heads adjacent to an imaging blanket 204 and configured for and able to deliver and provide a negative imagewise layer of fountain solution onto the imaging blanket 204 in a negative imagewise manner. A gap between the printhead array 202 and a surface of the imaging blanket 204, may be about 0.5 mm or less. The imaging blanket 204 has an outer surface that is tailored to the specific fountain solution being jetted by the printhead array 204. In certain embodiments, there may alternatively be an imaging roll having similar properties and characteristics as the imaging blanket 204 as described herein which is positioned between printhead array 202 and imaging blanket 204. An exemplary fountain solution for use in such a process is D4, or octamethylcyclotetrasiloxane, although other liquids, either water-based or synthetic, can be used. The fountain solution liquid must have suitable viscosity and surface tension to allow it to be jetted. The fountain solution is also selected based on its surface tension or its ability to reject wetting of ink to its surface and to wet the polymer substrates used in the module for direct transfer marking process 200. The surface of the imaging blanket 204 is designed to be receptive to the fountain solution and to have controlled compliance. This implies that the imaging blanket 204 material surface energy be sufficiently high relative to the fountain solution to enable good wetting and spread of the jetted drops from the printhead array 202. It should be noted that only a single fountain solution and imaging blanket 204 material set is required, regardless of the number of inks used in the total printing system architecture. As the imaging blanket 204 rotates during or after receiving the negative imagewise layer of fountain solution on a surface of the imaging blanket 204, a continuous web of non-absorbent media or substrate 206 enters the module for direct transfer marking process 200 and contacts the surface of the imaging blanket 204, thus transferring the negative imagewise layer of fountain solution from the imaging blanket 204 to the substrate 206. The patterned fountain solution image on the blanket next passes directly into a transfer nip with the substrate 206 formed between the imaging blanket 204 and a first backer roll 208 in contact with the imaging blanket 204. Sufficient pressure and nip conformity are applied such that the patterned fountain solution film forcibly wets the substrate 206 within the nip. As the substrate 206 exits the transfer nip, the fountain solution film will split and approximately half the film thickness will have transferred to the substrate 206. The residual fountain solution on the imaging blanket 204 must be evaporated, or otherwise removed, from the imaging blanket 204 and can optionally be reclaimed for reuse. This is accomplished by the fountain solution reclaim station 214 adjacent to the imaging blanket 204 in a post-transfer nip location. The substrate 206 next enters the inker station 212 where ink is deposited onto the substrate wherever the fountain solution does not reject the ink. The inker roll or inking station 212 can be a conventional anilox roll assembly, which forms a transfer nip between a second backer roll 210 in contact with the inking station 212. The inking station 212 is positioned downstream process-wise from the imaging blanket 204. The ink can have a wide range in viscosity, so that flexographic, gravure, and lithographic inks can all be useful in this module 200. For example, a flexographic ink having a dynamic viscosity of from about 50 cP to about 5000 cP or a lithographic ink having a dynamic viscosity from about 40,000 cP to about 100,000 cP are candidates for use. Inks may be either solvent based, such as water or alcohol-based, or radiation cured such as ultraviolet (UV) or electron-beam (EB) curable inks. The primary functional requirements are such that the process puts on the ink in a manner that it can forcibly wet the substrate 206 and can be rejected by the fountain solution. After the substrate 206 exits the inking station 212, the residual fountain solution on the substrate 206 can be evaporated and can be optionally reclaimed. The substrate 206 next passes through a suitable fixing, drying or curing station 216. The fixing, drying or curing station 216 may include an ultraviolet radiation source, an electron-beam curing source, heat source, infrared radiation source, or a combination thereof. The marking module 200 is thus capable of applying a single digitally applied color separation onto the substrate 206. The direction 218 of media travel throughout process is also indicated.

The deposited or ejected fountain solution film thickness on the blanket may be in the range of 1-5 microns, depending on the inkjet drop volume and area coverage. For example, assuming an effective drop volume of 10 pl at a 600×600 dots per inch (dpi) resolution, the film thickness on the imaging blanket 204 is 5.6 microns, so the film thickness on the substrate 206 would be about 2.8 microns. This is over an order of magnitude thicker than that produced with existing vapor deposition process in digital lithographic printing processes. A thinner film would be possible by jetting smaller effective drop volumes and/or by utilizing an intermediate imaging roll located between the printhead array 202 and the imaging blanket 204. This would introduce a second film splitting of a patterned image. This therefore cuts the final film thickness to 1.4 microns in this example, at the possible risk of losing some resolution of fine features. One application of interest for the system shown in FIG. 2 could be for a fully digital 'patch generator' onto a substrate. For example, a patch of white ink could be applied by this module 200 upstream of a color UV ink jet printing system. This provides the advantages of using a flexographic or roto-gravure type white ink in a fully digital marker system. Compared to an ink jet ink, these higher viscosity, flexographic-type inks have higher pigment loading and thus can provide opacity and reflectivity at much thinner ink film thicknesses. System complexities of dealing with white pigment settling within inkjet inks can be avoided by using the much higher viscosity inks which the embodiment shown in FIG. 2 allows. Another possible application is for use as a digital variable data annotator used in conjunction with an analog printing press, offering similar advantages over a conventional inkjet annotator.

Figure 3A:
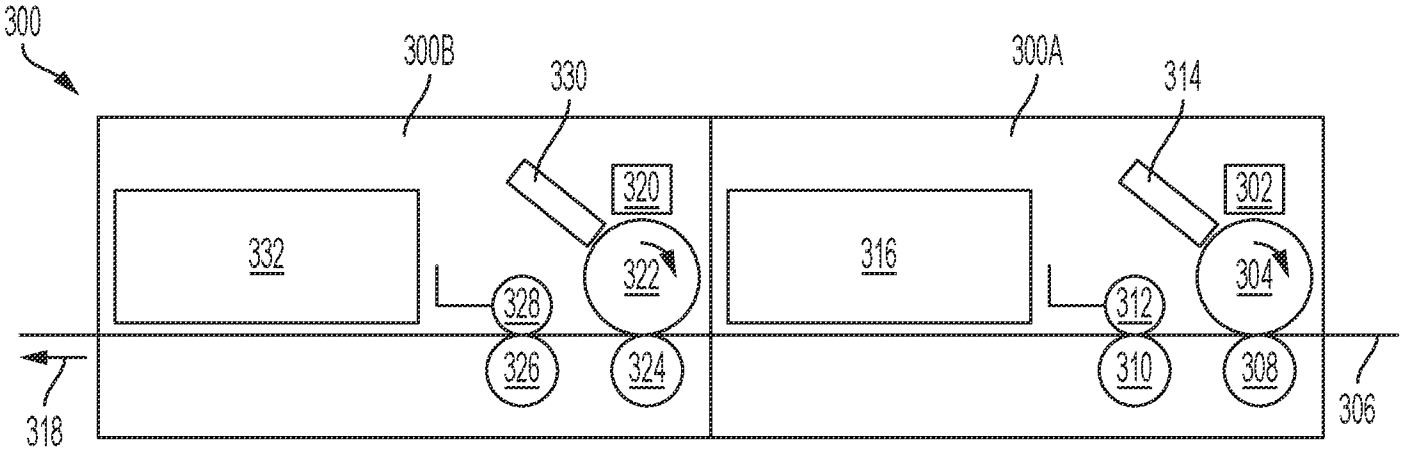
FIG. 3A. is a schematic view of a printing system, including an array of modules for a direct transfer marking process, according to an embodiment.

FIG. 3A. is a schematic view of a printing system, including an array of modules for a direct transfer marking process, according to an embodiment. FIG. 3A illustrates a two-color printing system including two marking modules in series. Each color separation may be partially or fully cured prior to application of the next separation in order to avoid any retransfer or interference between colors. If a matched ink set is used, for instance one with progressively high ink viscosities between separations, it is possible that no inter-color curing is required. This view represents a scalable system, and additional color separations are feasible in certain embodiments. An array of modules for a direct transfer marking process 300, in this case two, is shown. The array includes a first module enclosure 300A and a second module enclosure 300B. The first modular enclosure 300A for the direct transfer marking process includes a printhead array 302 which refers to one or more drop-on-demand print heads adjacent to an imaging blanket 304 and configured for and able to deliver and provide a negative imagewise layer, or non-imagewise layer, of fountain solution onto the imaging blanket 304 in a negative imagewise manner. A gap between the printhead array 302 and a surface of the imaging blanket 304, may be about 0.5 mm or less. The imaging blanket 304 has an outer surface that is tailored to the specific fountain solution being jetted or ejected by the printhead array 304. In certain embodiments, the imaging member may alternatively be an imaging roll having similar properties and characteristics as the imaging blanket 304 as described herein. Additionally, there may be a backer roll, not shown herein, or other member behind or as a portion of the imaging member for the purpose of applying pressure to the back or underside of the imaging member. An exemplary fountain solution for use in such a process is D4, or octamethylcyclotetrasiloxane, although other liquids, either water-based or synthetic, can be used. The fountain solution liquid must have suitable viscosity and surface tension to allow it to be jetted. The fountain solution is also selected based on its surface tension or its ability to reject wetting of ink to its surface and to wet the polymer substrates used in the array of modules for a direct transfer marking process 300. The surface of the imaging blanket 304 is designed to be receptive to the fountain solution and to have controlled compliance. This implies that the imaging blanket 304 material surface energy be sufficiently high relative to the fountain solution to enable good wetting and spread of the jetted drops from the printhead array 302. It should be noted that only a single fountain solution and imaging blanket 304 material set is required, regardless of the number of inks used in the total printing system architecture. As the imaging blanket 304 rotates during or after receiving the negative imagewise layer of fountain solution on a surface of the imaging blanket 304, a continuous web of non-absorbent media or substrate 306 enters the module for direct transfer marking process 300 and contacts the surface of the imaging blanket 304, thus transferring the negative imagewise layer of fountain solution from the imaging blanket 304 to the substrate 306. The patterned fountain solution image on the blanket next passes directly into a transfer nip with the substrate 306 formed between the imaging blanket 304 and a first backer roll 308 in contact with the imaging blanket 304. Sufficient pressure and nip conformity are applied such that the patterned fountain solution film forcibly wets the substrate 306 within the nip. As the substrate 306 exits the transfer nip, the fountain solution film will split and approximately half the film thickness will have transferred to the substrate 306. The residual fountain solution on the imaging blanket 304 must be evaporated, or otherwise removed, from the imaging blanket 304 and can optionally be reclaimed for reuse. This is accomplished by the fountain solution reclaim station 314 adjacent to the imaging blanket 304 in a post-transfer nip location. The substrate 306 next enters the inker station 312 where ink is deposited onto the substrate wherever the fountain solution does not reject the ink. The inker roll or inking station 312 can be a conventional anilox roll assembly, which forms a transfer nip between a second backer roll 310 in contact with the inking station 312. The inking station 312 is positioned downstream process-wise from the imaging blanket 304. The ink can have a wide range in viscosity, so that flexographic, gravure, and lithographic inks can all be useful in this module 200. For example, a flexographic ink having a dynamic viscosity of from about 50 cP to about 5000 cP or a lithographic ink having a dynamic viscosity from about 40,000 cP to about 100,000 cP are candidates for use. Inks may be either solvent based, such as water or alcohol-based, or radiation cured such as ultraviolet (UV) or electron-beam (EB) curable inks. The primary functional requirements are such that the process puts on the ink in a manner that it can forcibly wet the substrate 306 and can be rejected by the fountain solution. After the substrate 306 exits the inking station 312, the residual fountain solution on the substrate 306 can be evaporated and can be optionally reclaimed. The substrate 306 next passes through a suitable fixing, drying or curing station 316. The fixing, drying or curing station 316 may include an ultraviolet radiation source, an electron-beam curing source, heat source, infrared radiation source, or a combination thereof. The contents of the first modular enclosure 300A are thus capable of applying a single digitally applied color separation onto the substrate 306. The direction 318 of media travel throughout process is also indicated, which transports the substrate 306 into the second module enclosure 300B of the array of modules for a direct transfer marking process 300.

The second modular enclosure 300B for the direct transfer marking process includes a printhead array 320 which refers to one or more drop-on-demand print heads adjacent to an imaging blanket 322 and configured for and able to deliver and provide a negative imagewise layer of fountain solution onto the imaging blanket 322 in a negative imagewise manner for a second color separation. A gap between the printhead array 320 and a surface of the imaging blanket 322, may be about 0.5 mm or less. The imaging blanket 322 has an outer surface that is tailored to the specific fountain solution being jetted by the printhead array 322. In certain embodiments, the imaging member may alternatively be an imaging roll having similar properties and characteristics as the imaging blanket 322 as described herein. Additionally, there may be a backer roll, not shown herein, or other member behind or as a portion of the imaging member for the purpose of applying pressure to the back or underside of the imaging member. An exemplary fountain solution for use in such a process is D4, or octamethylcyclotetrasiloxane, although other liquids, either water-based or synthetic, can be used. The fountain solution liquid must have suitable viscosity and surface tension to allow it to be jetted. The fountain solution is also selected based on its surface tension or its ability to reject wetting of ink to its surface and to wet the polymer substrates used in the array of modules for a direct transfer marking process 300. The surface of the imaging blanket 322 is designed to be receptive to the fountain solution and to have controlled compliance. This implies that the imaging blanket 322 material surface energy be sufficiently high relative to the fountain solution to enable good wetting and spread of the jetted drops from the printhead array 320. It should be noted that only a single fountain solution and imaging blanket 322 material set is required, regardless of the number of inks used in the total printing system architecture. As the imaging blanket 322 rotates during or after receiving the negative imagewise layer of fountain solution on a surface of the imaging blanket 322, a continuous web of non-absorbent media or substrate 306 enters the second modular enclosure 300B of the array of modules for a direct transfer marking process 300 and contacts the surface of the imaging blanket 322, thus transferring the negative imagewise layer of fountain solution from the imaging blanket 322 to the substrate 306, over and beside the previously printed image from the first modular enclosure 300A. The patterned fountain solution image on the blanket next passes directly into a transfer nip with the substrate 306 formed between the imaging blanket 322 and a first backer roll 324 in contact with the imaging blanket 322. Sufficient pressure and nip conformity are applied such that the patterned fountain solution film forcibly wets the substrate 306 within the nip. As the substrate 306 exits the transfer nip, the fountain solution film will split and approximately half the film thickness will have transferred to the substrate 306. The residual fountain solution on the imaging blanket 322 must be evaporated, or otherwise removed, from the imaging blanket 322 and can optionally be reclaimed for reuse. This is accomplished by the fountain solution reclaim station 330 adjacent to the imaging blanket 322 in a post-transfer nip location. The substrate 306 next enters the inker station 328 where ink is deposited onto the substrate wherever the fountain solution does not reject the ink. The inker roll or inking station 328 can be a conventional anilox roll assembly, which forms a transfer nip between a second backer roll 326 in contact with the inking station 328. The inking station 328 is positioned downstream process-wise from the imaging blanket 322. The ink can have a wide range in viscosity, so that flexographic, gravure, and lithographic inks can all be useful in this module 200. For example, a flexographic ink having a dynamic viscosity of from about 50 cP to about 5000 cP or a lithographic ink having a dynamic viscosity from about 40,000 cP to about 100,000 cP are candidates for use. Inks may be either solvent based, such as water or alcohol-based, or radiation cured such as ultraviolet (UV) or electron-beam (EB) curable inks. The primary functional requirements are such that the process puts on the ink in a manner that it can forcibly wet the substrate 306 and can be rejected by the fountain solution. After the substrate 306 exits the inking station 328, the residual fountain solution on the substrate 306 can be evaporated and can be optionally reclaimed. The substrate 306 next passes through a suitable fixing, drying or curing station 332. The fixing, drying or curing station 332 may include an ultraviolet radiation source, an electron-beam curing source, heat source, infrared radiation source, or a combination thereof. The second modular enclosure 300B is thus capable of applying a single digitally applied color separation onto the substrate 306. The array of modules 300 may not be limited to two modules, each printing a single color, but may have one to ten modules, or more. The direction 318 of media travel throughout process is also indicated which indicates the direction of the substrate 306 travel out of the array of modules 300, or into successive modules in the system, or even a secondary printing operation, a secondary packaging operation, or a combination thereof.

Figure 3B:
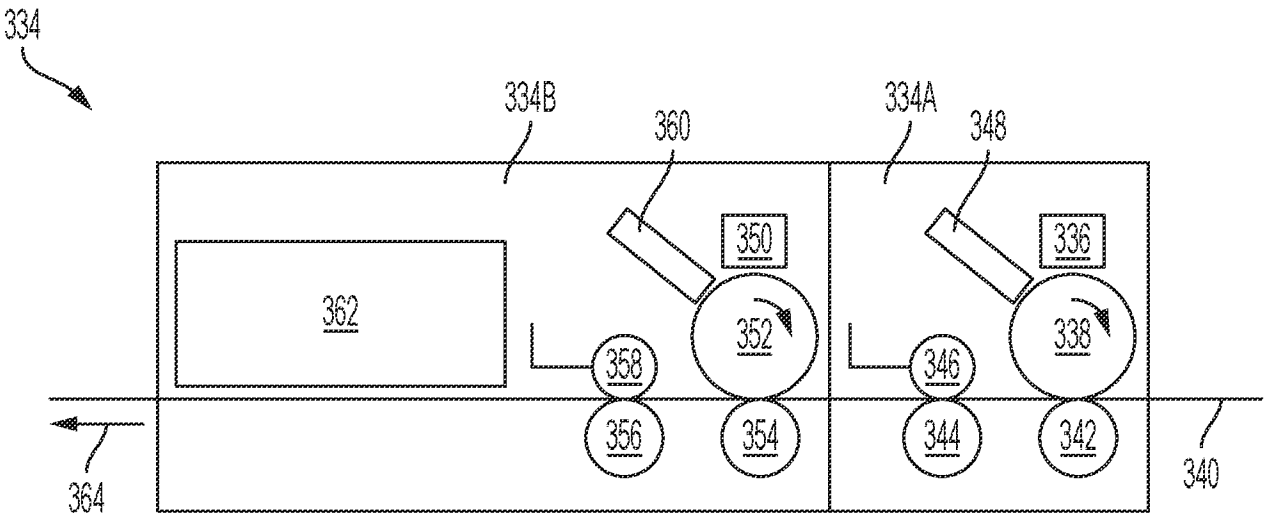
FIG. 3B is a schematic view of a printing system, including an array of modules for a direct transfer marking process, according to an embodiment.

FIG. 3B illustrates a two-color printing system including two marking modules in series. Each color separation in this embodiment is not partially or fully cured prior to application of the next separation. This view represents a scalable system, and additional color separations are feasible in certain embodiments. An array of modules for a direct transfer marking process 334, in this case two, is shown. The array includes a first module enclosure 334A and a second module enclosure 334B. The first modular enclosure 334A for the direct transfer marking process includes a printhead array 336 adjacent to an imaging blanket 338 and configured for and able to deliver and provide a negative imagewise layer of fountain solution onto the imaging blanket 338 in a negative imagewise manner. A gap between the printhead array 336 and a surface of the imaging blanket 338, may be about 0.5 mm or less. The imaging blanket 338 has an outer surface that is tailored to the specific fountain solution being jetted by the printhead array 338. In certain embodiments, the imaging member may alternatively be an imaging roll having similar properties and characteristics as the imaging blanket 338 as described herein. Additionally, there may be a backer roll, not shown herein, or other member behind or as a portion of the imaging member for the purpose of applying pressure to the back or underside of the imaging member. An exemplary fountain solution for use in such a process is D4, or octamethylcyclotetrasiloxane, although other liquids, either water-based or synthetic, can be used. The fountain solution liquid must have suitable viscosity and surface tension to allow it to be jetted. The fountain solution is also selected based on its surface tension or its ability to reject wetting of ink to its surface and to wet the polymer substrates used in the array of modules for a direct transfer marking process 334. The surface of the imaging blanket 338 is designed to be receptive to the fountain solution and to have controlled compliance. This implies that the imaging blanket 338 material surface energy be sufficiently high relative to the fountain solution to enable good wetting and spread of the jetted drops from the printhead array 336. It should be noted that only a single fountain solution and imaging blanket 338 material set is required, regardless of the number of inks used in the total printing system architecture. As the imaging blanket 338 rotates during or after receiving the negative imagewise layer of fountain solution on a surface of the imaging blanket 338, a continuous web of non-absorbent media or substrate 340 enters the module for direct transfer marking process 334 and contacts the surface of the imaging blanket 338, thus transferring the negative imagewise layer of fountain solution from the imaging blanket 338 to the substrate 340. The patterned fountain solution image on the blanket next passes directly into a transfer nip with the substrate 340 formed between the imaging blanket 338 and a first backer roll 342 in contact with the imaging blanket 338. Sufficient pressure and nip conformity are applied such that the patterned fountain solution film forcibly wets the substrate 340 within the nip. As the substrate 340 exits the transfer nip, the fountain solution film will split and approximately half the film thickness will have transferred to the substrate 340. The residual fountain solution on the imaging blanket 338 must be evaporated, or otherwise removed, from the imaging blanket 338 and can optionally be reclaimed for reuse. This is accomplished by the fountain solution reclaim station 348 adjacent to the imaging blanket 338 in a post-transfer nip location. The substrate 340 next enters the inker station 346 where ink is deposited onto the substrate wherever the fountain solution does not reject the ink. The inker roll or inking station 346 can be a conventional anilox roll assembly, which forms a transfer nip between a second backer roll 344 in contact with the inking station 346. The inking station 346 is positioned downstream process-wise from the imaging blanket 338. The ink can have a wide range in viscosity, so that flexographic, gravure, and lithographic inks can all be useful in this first modular enclosure 334A or within the array of modules 334, as described in regard to previous embodiments.

The substrate 340 next passes through to a second modular enclosure 334B. The contents of the first modular enclosure 334A are capable of applying a single digitally applied color separation onto the substrate 340. The direction 364 of media travel throughout process is also indicated, which transports the substrate 340 into the second module enclosure 334B of the array of modules for a direct transfer marking process 334. The second modular enclosure 334B for the direct transfer marking process includes a printhead array 350 which refers to one or more drop-on-demand print heads adjacent to an imaging blanket 352 and configured for and able to deliver and provide a negative imagewise layer of fountain solution onto the imaging blanket 352 in a negative imagewise manner for a second color separation. Again, a gap between the printhead array 350 and a surface of the imaging blanket 352, may be about 0.5 mm or less. The imaging blanket 352 has an outer surface that is tailored to the specific fountain solution being jetted by the printhead array 352. In certain embodiments, the imaging member may alternatively be an imaging roll having similar properties and characteristics as the imaging blanket 352 as described herein. Additionally, there may be a backer roll, not shown herein, or other member behind or as a portion of the imaging member for the purpose of applying pressure to the back or underside of the imaging member. An exemplary fountain solution for use in such a process is D4, or octamethylcyclotetrasiloxane, although other liquids, either water-based or synthetic, can be used. The fountain solution liquid must have suitable viscosity and surface tension to allow it to be jetted. The fountain solution is also selected based on its surface tension or its ability to reject wetting of ink to its surface and to wet the polymer substrates used in the array of modules for a direct transfer marking process 334. The surface of the imaging blanket 352 is designed to be receptive to the fountain solution and to have controlled compliance. This implies that the imaging blanket 352 material surface energy be sufficiently high relative to the fountain solution to enable good wetting and spread of the jetted drops from the printhead array 350. It should be noted that only a single fountain solution and imaging blanket 352 material set is required, regardless of the number of inks used in the total printing system architecture. As the imaging blanket 352 rotates during or after receiving the negative imagewise layer of fountain solution on a surface of the imaging blanket 352 the continuous web of non-absorbent media or substrate 340 enters the second modular enclosure 334B of the array of modules for a direct transfer marking process 334 and contacts the surface of the imaging blanket 352, thus transferring the negative imagewise layer of fountain solution from the imaging blanket 352 to the substrate 340, over and beside the previously printed image from the first modular enclosure 334A. There may be additional distance or time passed between a printing operation of the first modular enclosure 334A and the second modular enclosure 334B to allow an ink to dry, if necessary. The patterned fountain solution image on the blanket next passes directly into a transfer nip with the substrate 340 formed between the imaging blanket 352 and a first backer roll 354 in contact with the imaging blanket 352. Sufficient pressure and nip conformity are applied such that the patterned fountain solution film forcibly wets the substrate 340 within the nip. As the substrate 340 exits the transfer nip, the fountain solution film will split and approximately half the film thickness will have transferred to the substrate 340. The residual fountain solution on the imaging blanket 352 must be evaporated, or otherwise removed, from the imaging blanket 352 and can optionally be reclaimed for reuse. This is accomplished by the fountain solution reclaim station 360 adjacent to the imaging blanket 352 in a post-transfer nip location. The substrate 340 next enters the inker station 358 where ink is deposited onto the substrate wherever the fountain solution does not reject the ink. The inker roll or inking station 358 can be a conventional anilox roll assembly, which forms a transfer nip between a second backer roll 356 in contact with the inking station 358. The inking station 358 is positioned downstream process-wise from the imaging blanket 352. The ink can have a wide range in properties as described in regard to previous embodiments.

After the substrate 340 exits the inking station 358, the residual fountain solution on the substrate 340 can be evaporated and can be optionally reclaimed. The substrate 340 next passes through a suitable fixing, drying or curing station 362. The fixing, drying or curing station 362 may include an ultraviolet radiation source, an electron-beam curing source, heat source, infrared radiation source, or a combination thereof. The second modular enclosure 334B is thus capable of applying a second, single digitally applied color separation onto the substrate 340. The array of modules 334 may not be limited to two modules, each printing a single color, but may have one to ten modules, or more. The direction 364 of media travel throughout process is also indicated which indicates the direction of the substrate 340 travel out of the array of modules 334, or into successive modules in the system, or even a secondary printing operation, a secondary packaging operation, or a combination thereof.

Figure 4:
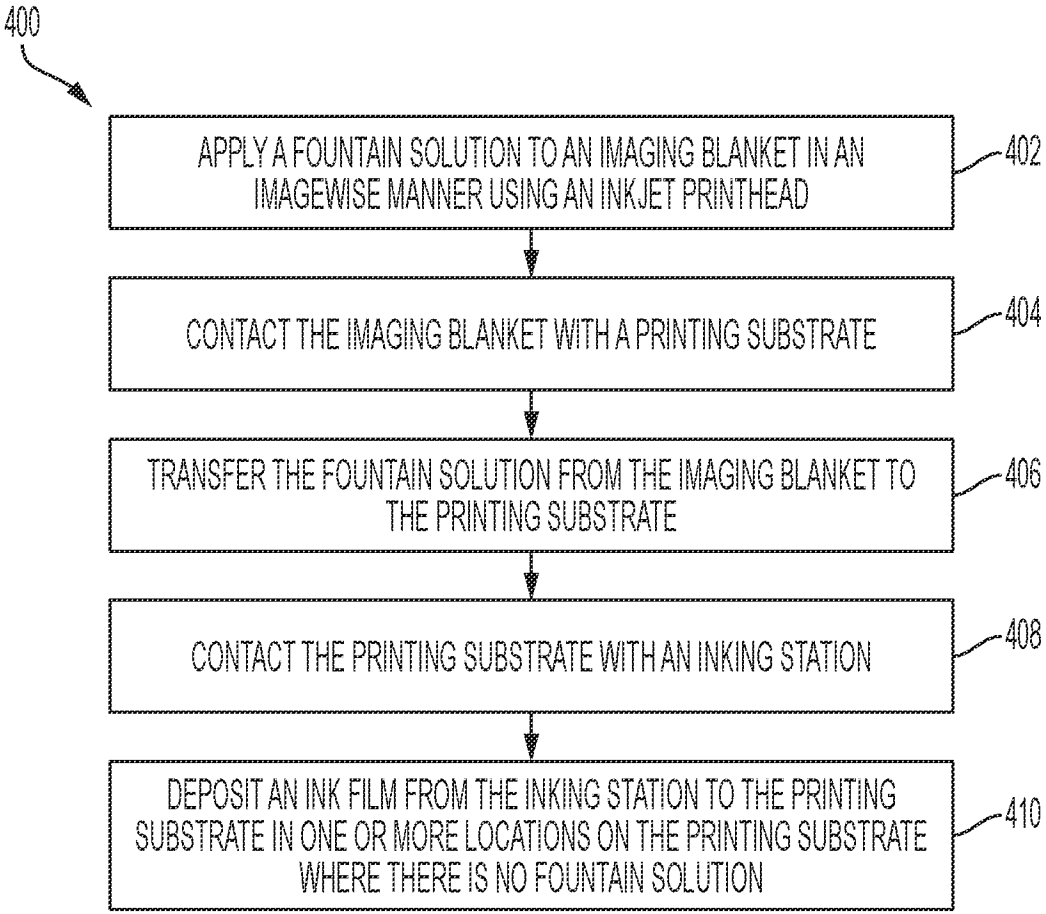
FIG. 4 is a flowchart illustrating a method for direct transfer printing, according to an embodiment.

FIG. 4 is a flowchart illustrating a method for direct transfer printing, according to an embodiment. A method for direct transfer printing 400 includes the application of a fountain solution to an imaging blanket in a negative imagewise manner, also referred to as a non-imagewise manner, using an inkjet printhead 402, contacting the imaging blanket with a printing substrate 404, transferring the fountain solution from the imaging blanket to the printing substrate 406, contacting the printing substrate with an inking station 408, and depositing an ink film from the inking station to the printing substrate in one or more locations on the printing substrate where there is no fountain solution 410. In the foregoing method for direct transfer printing 400, the fountain solution may be octamethylcycletetrasiloxane. The method for direct transfer printing 400 may include the application of pressure to a backside of the imaging blanket when the imaging blanket is contacting the printing substrate, or the application of pressure to a backside of the printing substrate when the printing substrate is contacting the imaging blanket. The method for direct transfer printing 400 may include the application of pressure to a backside of the printing substrate when the printing substrate is contacting the inking station. The method for direct transfer printing 400 may also include fixing the ink film to the printing substrate. The fixing of the ink film may include the use of elevated temperature, ultraviolet radiation, or other means. The method for direct transfer printing 400 may include removing residual fountain solution from the printing substrate or removing residual fountain solution from the imaging blanket. The method for direct transfer printing 400 may include may include the transport of the printing substrate with the ink film to a subsequent printing operation, a rewinding operation, or a packaging operation which may include any of overcoating, laminating, and slitting processes, or a combination thereof.

Several advantages of the foregoing method and apparatus related to direct transfer variable lithographic printing include the use of some technology elements of existing printing systems and processes while removing others. This may reduce complexity and cost in such printing methods and systems. Most importantly, the infrared (IR) imager and the fountain solution deposition subsystem may be substituted with conventional piezoelectric drop-on-demand printheads. The imaging blanket remains, but it has fewer critical functions to satisfy. For example, the imaging blanket in certain embodiments as described herein do not need to absorb IR radiation and does not have any ink contact. Therefore, cleaning subsystems for removing any residual ink from the imaging blanket surface may also be eliminated. The inking station technology can largely be reused from existing printing systems. The fountain solution reclaim subsystem may use conventional evaporative and/or mechanical means to remove fountain solution from the imaging blanket. In certain embodiments, the imaging blanket may be in belt form, rather than on a roller or drum, which permits additional module architectural flexibility. For example, a belt-based imaging blanket would allow an increased waterfront area for the fountain solution reclaim process.

Embodiments as described herein has additional potential advantages over ink jet printing onto plastic media based on the different ink that can be used. This system can use inks with viscosities in the range of 50-100,000 cP or higher, whereas ink jet requires viscosities of 10 cP or lower. The use of these higher viscosity inks brings several functional advantages for packaging applications, such as thinner ink layers, approximately 10 times thinner than ink jet, thereby allowing reduced operating costs, higher molecular weight ink components adhere better and migrate less in food packaging applications, and greater design flexibility in inks since there is no jetting requirement related to ink compositions.

Exemplary embodiments of printing systems and methods as described herein also offer much improved design flexibility with respect to inks. Current ink design must incorporate both inking and release from a low surface energy imaging blanket surface. Inking and releasing have conflicting functional properties, which therefore limits the available design space. This removed constraint on ink design allows for improved ink design parameters and may lead to improved ink flow and improved image quality metrics, such as solid fill. Further advantages in printhead reliability, as compared to printheads used in systems that must process multiple ink types and designs, may be realized.

Furthermore, the fountain solution does not have the same media interaction requirements of an inkjet ink, so it may be better tuned for good jettability and maintainability. The jetting substrate is an elastomeric imaging blanket, and the jetting zone is physically distanced from the substrate media. Accordingly, the printhead-to-blanket gap can be more tightly spaced than otherwise is practical. This gap could easily be held to 0.5 mm or less, resulting in lower misdirection error from individual nozzles. Another inherent concern with inkjet and related printhead technology is streakiness. The above conditions will also result in less opportunity for missing or misdirected pixels. Additionally, the spread of the fountain solution on the imaging blanket can be well-controlled since the surface properties of the imaging blanket are relatively invariant, as compared to the wide range of wetting properties of the substrate media. The mechanism of forced wetting of the patterned fountain solution onto the media or substrate is significantly different than the wetting and spreading of individual jetted drops onto the same media. While not being bound by theory, it is believed that the forced wetting mechanism is fundamentally advantaged in controlling the formation of a stable patterned fountain solution image onto the media or printing substrate. If the fountain solution were jetted directly onto the printing substrate, there would be no forced wetting, which means the individual drops of fountain solution must spread sufficiently onto the low surface energy substrate to avoid creating streaks. In practice, this is difficult to achieve due to the fountain solution's surface tension, resulting in the tendency to retain its droplet form and resist spreading. Thus, the forced wetting physics may also contribute to lower streakiness, and therefore improved image quality.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompasses by the following claims.

What is claimed is:

1. A method for direct transfer printing comprising:

applying a fountain solution to an imaging blanket in a negative imagewise manner using an inkjet printhead;

contacting the imaging blanket with a printing substrate;

transferring the fountain solution from the imaging blanket to the printing substrate;

contacting the printing substrate with an inking station; and depositing an ink film from the inking station to the printing substrate in one or more locations on the printing substrate where there is no fountain solution.

2. The method for direct transfer printing of claim 1, wherein the fountain solution is octamethylcyclotetrasiloxane.

3. The method for direct transfer printing of claim 1, further comprising applying pressure to a backside of the printing substrate when the imaging blanket is contacting the printing substrate.

4. The method for direct transfer printing of claim 1, further comprising applying pressure to a backside of the printing substrate when the printing substrate is contacting the imaging blanket.

5. The method for direct transfer printing of claim 1, further comprising applying pressure to a backside of the printing substrate when the printing substrate is contacting the inking station.

6. The method for direct transfer printing of claim 1, further comprising fixing the ink film to the printing substrate.

7. The method for direct transfer printing of claim 6, wherein the fixing of the ink film is completed using elevated temperature.

8. The method for direct transfer printing of claim 6, wherein the fixing of the ink film is completed using ultraviolet radiation.

9. The method for direct transfer printing of claim 1, further comprising removing residual fountain solution from the printing substrate.

10. The method for direct transfer printing of claim 1, further comprising transporting the printing substrate with the ink film to a subsequent printing operation, a packaging operation, or a combination thereof.

11. A module for a direct transfer marking process, comprising:

an imaging blanket;

a printhead for ejecting fountain solution onto the imaging blanket disposed adjacent to the imaging blanket;

an inking station positioned downstream from the imaging blanket configured to deposit an ink film to a printing substrate in one or more locations on the printing substrate; and one or more backer rolls in contact with and configured to provide pressure against the printing substrate.

12. The module for a direct transfer marking process of claim 11, further comprising a fixing station.

13. The module for a direct transfer marking process of claim 12, wherein the fixing station further comprises an ultraviolet radiation source.

14. The module for a direct transfer marking process of claim 11, wherein the printhead ejects fountain solution onto the imaging blanket in a negative imagewise manner.

15. The module for a direct transfer marking process of claim 11, further comprising a gap between the printhead and a surface of the imaging blanket, wherein the gap is about 0.5 mm or less.

16. The module for a direct transfer marking process of claim 11, wherein the inking station delivers an ink having a viscosity of from about 0.05 Pa-s to about 0.8 Pa-s.

17. A direct transfer printing system, comprising:

a first marking module, comprising:

a first imaging blanket;

a first printhead for ejecting fountain solution onto the first imaging blanket, disposed adjacent to the first imaging blanket;

a first inking station positioned downstream from the first imaging blanket configured to deposit an ink film to a printing substrate in one or more locations on the printing substrate; and one or more backer rolls in contact with and configured to provide pressure against the printing substrate; and a second marking module, comprising:

a second imaging blanket;

a second printhead for ejecting fountain solution onto the second imaging blanket, disposed adjacent to the second imaging blanket;

a second inking station positioned downstream from the second imaging blanket configured to deposit an ink film to a printing substrate in one or more locations on the printing substrate; and one or more backer rolls in contact with and configured to provide pressure against the printing substrate.

18. The direct transfer printing system of claim 17, further comprising a fixing station disposed between a location of the first marking module and a location of the second marking module.

19. The direct transfer printing system of claim 17, further comprising a fixing station disposed in a process-wise location subsequent to a location of the second marking module.

20. The direct transfer printing system of claim 17, wherein the first printhead ejects fountain solution onto the first imaging blanket in a negative imagewise manner and the second printhead ejects fountain solution onto the second imaging blanket in a negative imagewise manner.

* * * * *